US007444897B2

(12) United States Patent
Komine et al.

(10) Patent No.: US 7,444,897 B2
(45) Date of Patent: Nov. 4, 2008

(54) CONTROL PANEL UNIT HAVING CONTROL LEVER FOR UTILITY VEHICLE

(75) Inventors: Takahiro Komine, Sakai (JP); Hitoshi Aoyama, Kashiba (JP); Yutaka Inubushi, Sakai (JP); Yoshitaka Higashikawa, Sakai (JP); Hajime Shikiya, Kishiwada (JP)

(73) Assignee: Kubota Corporation, Osaka (JP)

( * ) Notice: Subject to any disclaimer, the term of this patent is extended or adjusted under 35 U.S.C. 154(b) by 631 days.

(21) Appl. No.: 10/936,206

(22) Filed: Sep. 8, 2004

(65) Prior Publication Data

US 2005/0139034 A1 Jun. 30, 2005

(30) Foreign Application Priority Data

Dec. 26, 2003 (JP) ..... 2003-433477

(51) Int. Cl.
*B60K 20/00* (2006.01)

(52) U.S. Cl. ..... 74/473.1; 74/471 R

(58) Field of Classification Search ..... 74/473.1, 74/471 R, 469, 473.19
See application file for complete search history.

(56) References Cited

U.S. PATENT DOCUMENTS

| | | | | |
|---|---|---|---|---|
| 3,135,234 | A * | 6/1964 | Turnidge | 440/86 |
| 3,714,846 | A | 2/1973 | Louis et al. | |
| 4,060,157 | A | 11/1977 | Hillstrom | |
| 4,991,535 | A | 2/1991 | Kobayashi et al. | |
| 6,138,528 | A * | 10/2000 | Fukumoto et al. | 74/745 |
| 6,446,521 | B1 * | 9/2002 | Hama et al. | 74/335 |
| 2003/0033898 | A1 | 2/2003 | Morimoto et al. | |

FOREIGN PATENT DOCUMENTS

| | | |
|---|---|---|
| JP | (1983) 58134147 | 8/1983 |
| JP | 6097630 | 7/1985 |
| JP | 60134147 | 7/1985 |
| JP | 2-62639 | 5/1990 |
| JP | 6097677 | 4/1994 |
| JP | (1994) 6165610 | 6/1994 |
| JP | 06165610 | 6/1994 |
| JP | 07008017 | 1/1995 |
| JP | (1996) 8276762 | 10/1996 |

* cited by examiner

*Primary Examiner*—David M Fenstermacher
(74) *Attorney, Agent, or Firm*—The Webb Law Firm

(57) ABSTRACT

A control panel unit has a control lever operable by a driver seated at a driver's seat of a utility vehicle. The panel unit includes a base panel which covers the control lever except for its control grip area and a guide slot defined in the base panel along an operational displacement of the control lever. The panel unit further includes an inclined panel portion inclined by a predetermined angle relative to the base panel so as to orient its surface toward the driver and extending adjacent and along the length of the guide slot. A display face is formed in the surface of the inclined panel portion and configured for displaying operational positions of the lever.

4 Claims, 15 Drawing Sheets

CONTROL PANEL UNIT HAVING CONTROL LEVER FOR UTILITY VEHICLE

BACKGROUND OF THE INVENTION

1. Field of the Invention

The present invention relates to a control panel unit having a control lever operable by a driver seated at a driver's seat of a utility vehicle. More particularly, the invention relates to a control panel unit including a base panel which covers the control lever except for its control grip area and a guide slot defined in the base panel along an operational displacement of the control lever.

2. Description of the Related Art

A conventional control panel unit of the above type, as known from e.g. Japanese Patent Application "Kokai" No.: 6-165610 (paragraph [0008], FIGS. 5 and 6), includes a fender (corresponding to "base panel") having a plurality of slots (corresponding to the "guide slot") in which a plurality of control levers are inserted respectively. So that, each control lever is operated by a driver seated at a driver's seat of the utility vehicle. With such control panel unit, indices such as numerals, marks are provided on the top face (display face) of the base panel for indicating operational positions of the respective control levers.

However, as the base panel is disposed horizontal, the display face too is disposed horizontal, it is difficult for the driver to see the indices thereon. Further, as an area available as the display face is limited, it is difficult to form the indices in sufficient sizes.

Japanese Utility Model Application "Kokai" No. 58-134147 discloses a control panel unit having an inclined base panel, so that its display face too is formed as an upwardly inclined face, as is shown in FIG. 22 herein. As the display face is formed as such inclined face oriented toward the driver, it is easier for the driver to see the indices thereon, compared with the above-described conventional construction. However, since the inclination of the base panel is severely limited by e.g. a construction of a control mechanism housed within the base panel and/or the particular design of the space of the driver's seat created outside the base panel, it has been practically impossible to provide an optimally inclined face to the driver.

SUMMARY OF THE INVENTION

In view of the above, a primary object of the present invention is to provide a control panel unit having a display face readily seen by the driver regardless of any particular design requirement for the base panel.

For accomplishing the above object, according to one aspect of the present invention, there is proposed a control panel unit having a control lever operable by a driver seated at a driver's seat of a utility vehicle, the control panel unit comprising: a base panel which covers the control lever except for its control grip area; a guide slot defined in the base panel along an operational displacement of the control lever; an inclined panel portion inclined by a predetermined angle relative to the base panel so as to orient its surface toward the driver and extending adjacent and along the length of the guide slot; and a display face formed in the surface of the inclined panel portion and configured for displaying operational positions of the lever.

According to a further aspect of the present invention, there is proposed a control panel unit having a plurality of control levers, e.g. a first control lever and a second control lever, operable by a driver seated at a driver's seat of a utility vehicle, the panel unit comprising: a base panel which covers the first and second control levers except for their control grip areas; a first guide slot defined in the base panel along an operational displacement of the first control lever; a second guide slot defined in the base panel along an operational displacement of the second control lever; a first inclined panel portion inclined by a predetermined angle relative to the base panel so as to orient its surface toward the driver and extending adjacent and along the length of the first guide slot; a second inclined panel portion inclined by a predetermined angle relative to the base panel so as to orient its surface toward the driver and extending adjacent and along the length of the second guide slot; a first display face formed in the surface of the first inclined panel portion and configured for displaying operational positions of the first control lever; and a second display face formed in the surface of the second inclined panel portion and configured for displaying operational positions of the second control lever.

With the above-described control panel units according to the present invention, irrespectively of the arrangement of the base panel, whether it being horizontal or inclined, as the inclined panel portion having an optimal inclination angle is disposed adjacent the guide slot, the display face displaying the lever operational positions formed in that inclined panel portion can be easily seen by the driver.

In order to form the display face over the entire operational (displacement) range of the control lever, the inclined panel portion can be formed along substantially an entire one side of a peripheral edge delimiting the guide slot.

The inclined panel portion can be formed as a bent piece formed by bending the base panel. This is advantageous, in particular, in reducing the manufacture cost. In this case, one end of the bent piece can be a portion of the peripheral edge delimiting the guide slot.

In the case of the control panel unit having a plurality of control levers, in case the second display face is disposed farther from the driver's seat than the first display face, the second display face can be located at a higher level than the first display face. This arrangement allows the driver to see both the first and second displace faces easily.

Further and other features and advantages of the present invention will become apparent upon reading following description of the preferred embodiments thereof with reference to the accompanying drawings.

DESCRIPTION OF THE PREFERRED EMBODIMENTS

Preferred embodiments of the invention will be described in details with reference to the accompanying drawings.

First Embodiment

Figure 1:
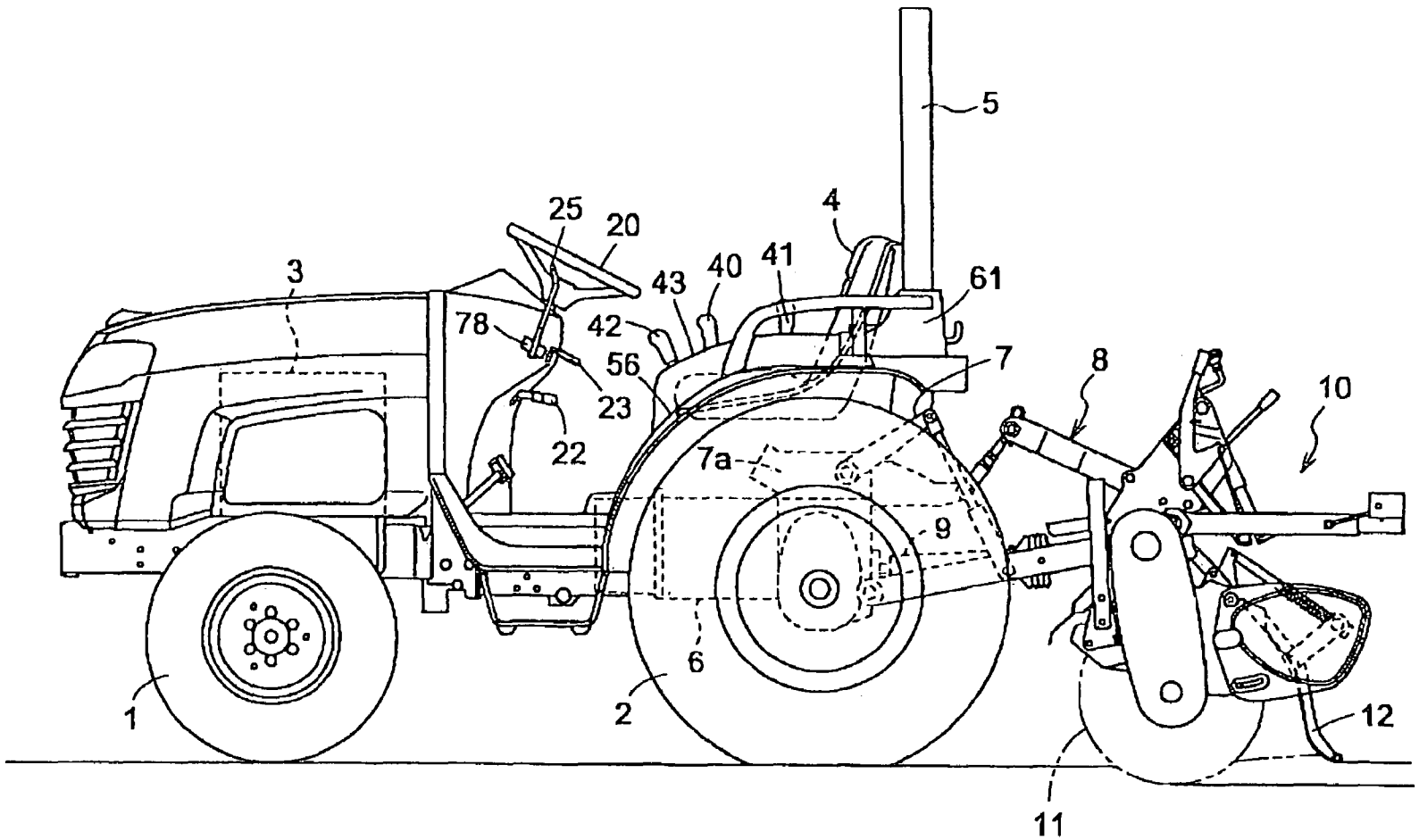
FIG. 1 is a side view showing a riding plowing vehicle in its entirety

FIG. 1 shows a tractor including a control panel unit relating to the present invention. To the rear side of this tractor, there is connected a rotary plow 10 via a link mechanism 8 having a pair of right and left lift arms 7. The tractor includes a pair of right and left steerable front wheels 1 and a pair of right and left rear wheels 2 which are driven by a power from an engine 3 mounted at an engine section, a driver's section having a drivers seat 4 disposed rearwardly of the engine section, and a protection frame 5 disposed rearwardly of the driver's seat 4. The driving power of the engine 3 is transmitted via a PTO shaft (not shown) mounted in a transmission case 6 to the rotary plow 10.

More particularly, when a hydraulic lift cylinder 7*a* provided within the transmission case 6 is operated, the lift cylinder 7*a* pivotally operates the pair of right and left lift arms 7 up/down, thereby to pivot the link mechanism 8 up/down relative to the transmission case 6, thus realizing a lowered operative condition of the rotary plow 10 where its plowing rotor 11 is placed on the ground surface and an elevated inoperative condition of the rotary plow 10 where the plowing rotor 11 is lifted up high off the ground surface. When the vehicle travels with placing the rotary plow 10 at the lowered operative condition, the plowing rotor 11 of the rotary plow 10 plows the field.

Figure 2:
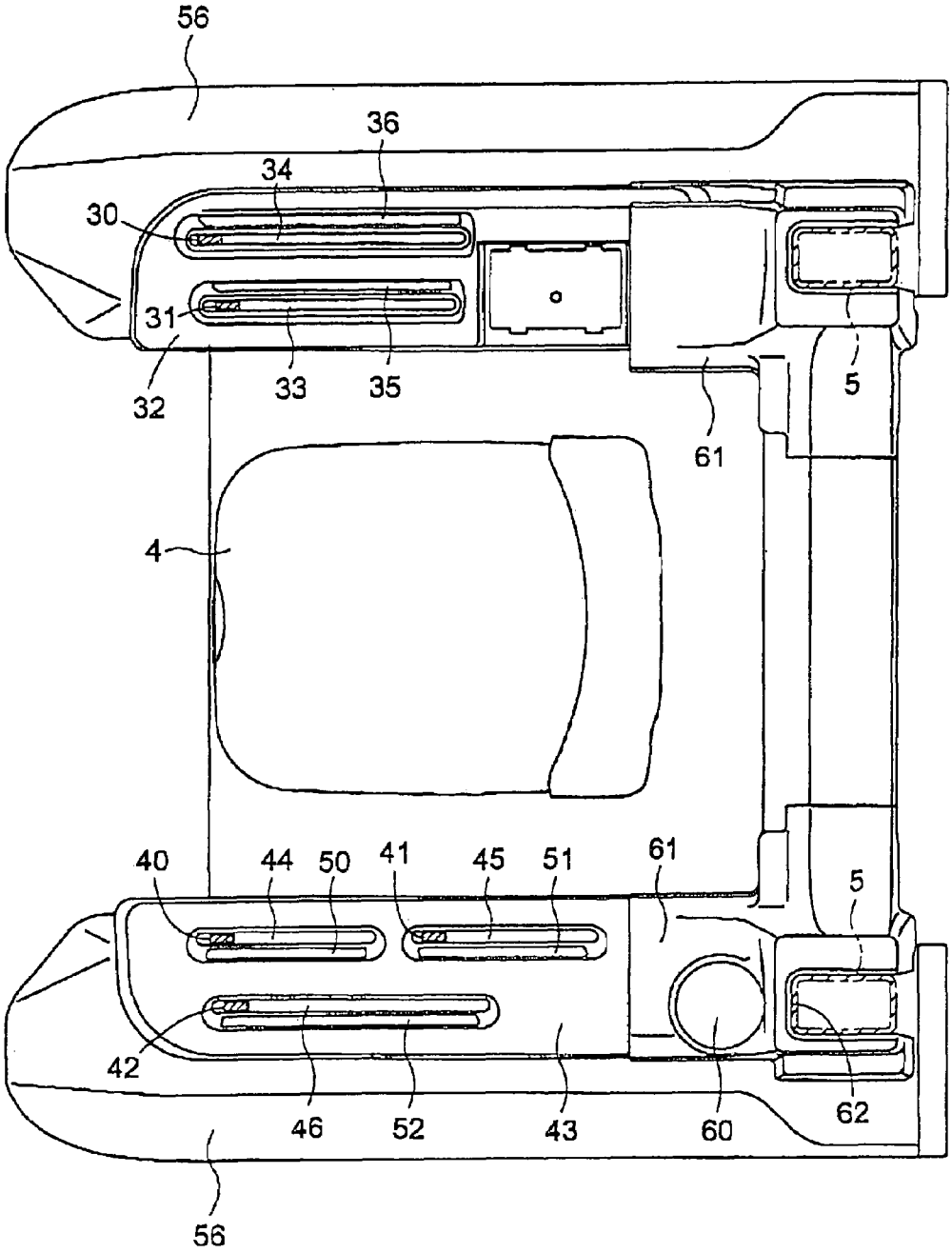
FIG. 2 is a plan view of a driver's section.
Figure 7:
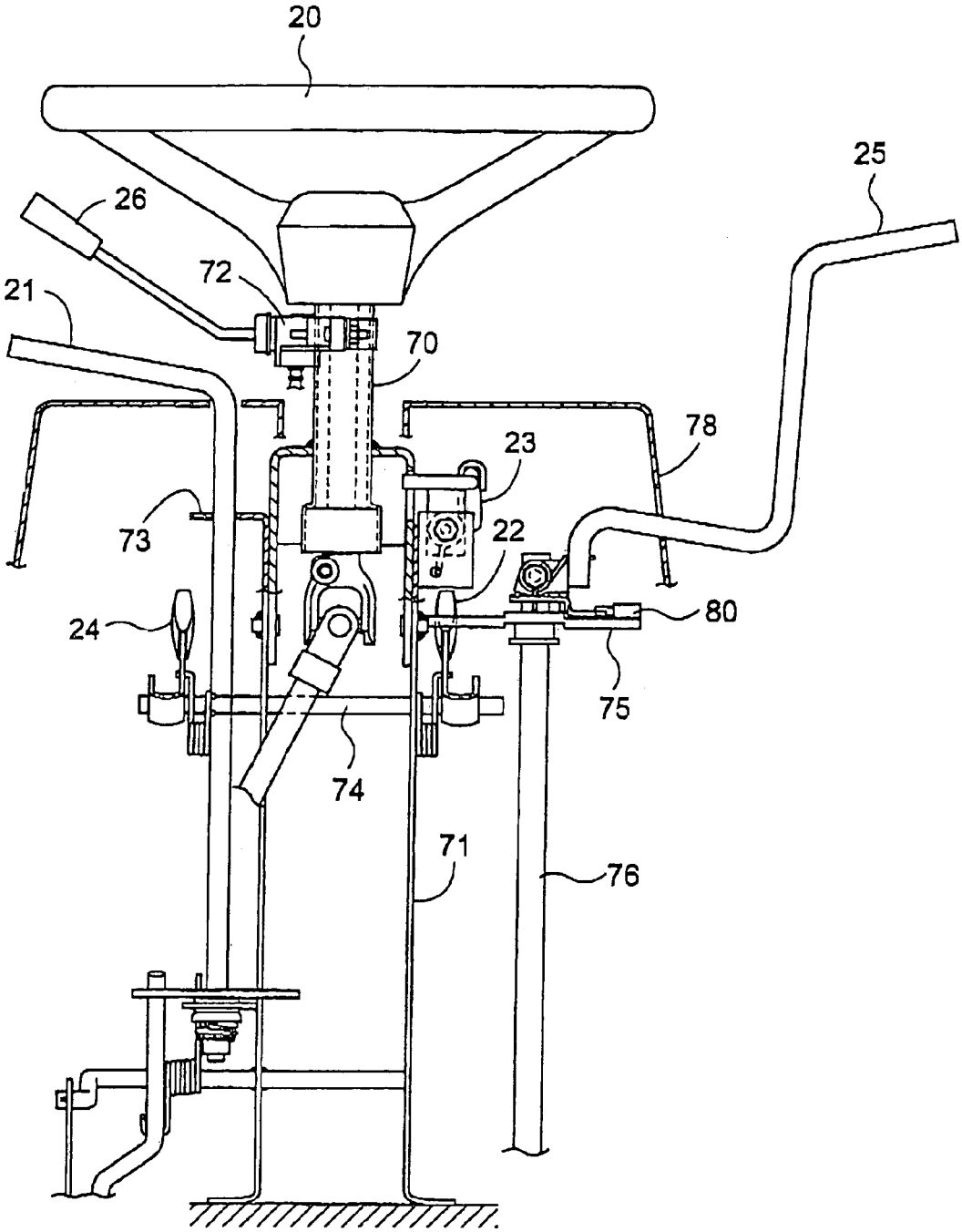
FIG. 7 is a front view showing a mounting portion of a steering wheel.

As shown in FIGS. 1, 2 and 7, in the drivers section, forwardly of the driver's seat 4, there are mounted a steering wheel 20 for steering the pair of right and left front wheels 1, a hand accelerator lever 21, a double speed lever 22, a tilt lever 23, a parking brake lever 24, a forward/reverse lever 25 and a lift lever 26. On the right lateral side of the driver's seat 4, there are provided a position lever 30, a plowing depth lever 31, and a base panel 32. On the left lateral side of the driver's seat 4, there are provided a main change speed lever 40, an auxiliary change speed lever 41, a PTO lever 42 and a base panel 43. On the left rear side of the diver's seat 4, there is provided a cup holder 60. All of the above-mentioned levers constitute the embodiment of the present invention. At the leading ends thereof, there are provided grip portions 30*a*, 41*a*, whereas portions downwardly thereof are covered by the base panel 32 which will be detailed later herein.

The plowing depth lever 31 is connected to a coupling mechanism (not shown) which operably couples a rotary rear cover 12 (FIG. 1) acting also as a plowing depth sensor for detecting a plowing depth of the rotary plow 10 and a control valve (not shown) for the lift cylinder 7*a*. That is, the coupling mechanism controls lifting up/down of the rotary plow 10 by automatically operating the control valve such that a plowing depth detected by the rotary rear cover 12 may be a set plowing depth. The plowing depth lever 31 (first control lever) effects switchover of the lift control for the rotary plow 10 between an engaged condition and a disengaged condition and also variably sets the set plowing depth as a control target plowing depth to be maintained by the lift control.

The position lever 30 (second control lever) is used for lifting up/down the rotary plow 10 by manually operating the control valve for the lift cylinder 7*a*.

Figure 3:
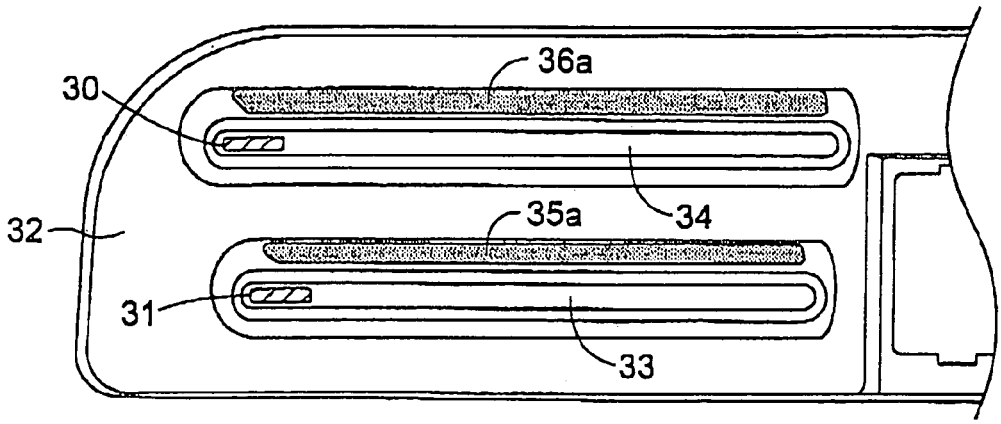
FIG. 3 is a plan view of a control panel unit including a plowing depth lever, and a position lever.
Figure 4:
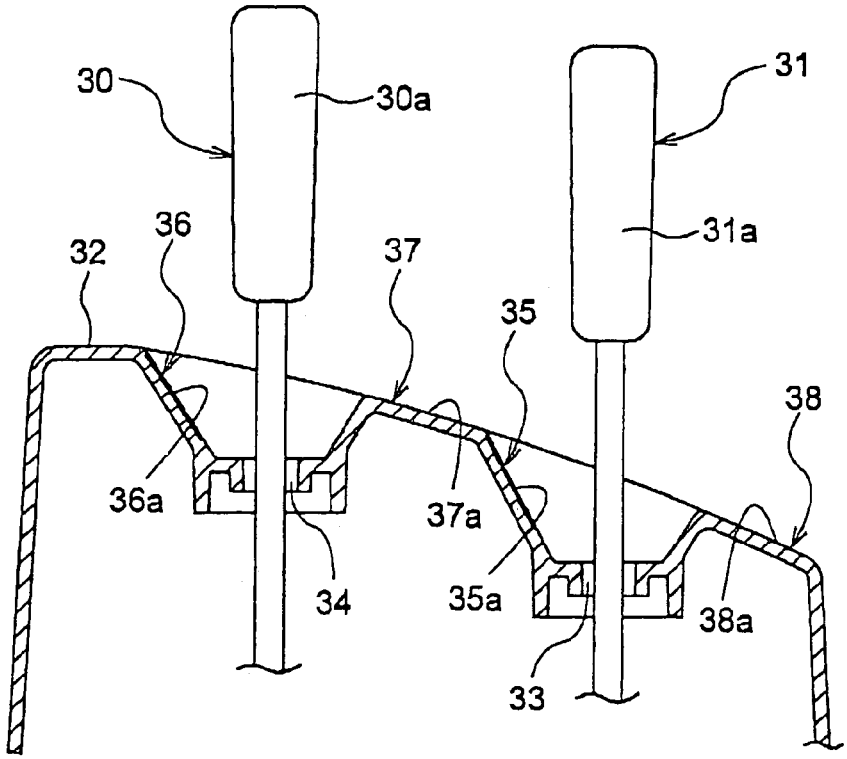
FIG. 4 is a section view of the control panel unit including the plowing depth lever, and the position lever.

As shown in FIGS. 3 and 4, the plowing depth lever 31 (first control lever) is inserted into a first guide slot 33 as one of a pair of guide slots 33, 34 defined side by side in the transverse direction of the vehicle body in the base panel 32 secured to a rear wheel fender 66. Whereas, the position lever 30 (second control lever) is inserted into the second guide slot 34 as the other one of the pair of the guide slots 33, 34. The guide slot 33 (first guide slot) forms an operational path of the plowing depth lever 31 along the fore and aft direction of the vehicle body. The guide slot 34 (second guide slot) forms an operational path for the position lever 30 along the fore and aft direction of the vehicle body. The operational path of the plowing depth lever 31 and the operational path of the position lever 30 are juxtaposed parallel with each other in the transverse direction of the vehicle body. As a result, the two levers 30, 31 are disposed side by side with a small distance therebetween in the transverse direction of the vehicle body. Marks 30*a* and 31*a* denote the grip portions of the respective levers.

In the base panel 32, of a peripheral edge of the guide slot 33 for the plowing depth lever 31, at the edge opposite to the side where the driver's seat 4 is located, there is formed an inclined panel portion (first inclined panel portion) 36 for the plowing depth lever 31. Of a peripheral edge of the guide slot 34 for the position lever 30, at the edge opposite to the side where the driver's seat 4 is located, there is formed an inclined panel portion (second inclined panel portion) 36 for the position lever 30. These two inclined panel portions 35 and 36 are formed as bent pieces of the base panel 32 simultaneously with the formation of the base panel 32.

The inclined panel portion 36 for the plowing depth lever 31 includes a display face (first display face) 35*a* having characters, marks, etc. for allowing visual confirmation of e.g. the plowing depth lever 31 setting the plowing depth control at its engaged condition or setting the set plowing depth at a shallow side or a deep side, etc. Similarly, the inclined panel portion 36 for the position lever 30 includes a display face (second display face) 36*a* having characters, marks, etc. for allowing visual confirmation of the position lever 30 being at a position for lifting up or down the rotary plow 10, etc. The display faces 35*a*, 36*a* of the respective inclined panel portions 35, 36 are inclined upward to be oriented toward the driver seated at the drivers seat and extend with a predetermined inclination angle relative to an upper face 37*a* of a partitioning portion 37 disposed between the two guide slots 33, 34 for partitioning these slots 33, 34 from each other.

An upper face 38*a* of an upper wall portion 38 which is a portion of the base panel 32 located on the inner side of the vehicle body than the plowing depth lever guide slot 33 as the guide slot closer to the driver's seat 4, and said upper face 37*a* of the partitioning portion 37 which is another portion of the base panel 32 respectively have such an inclination angle that the faces are formed higher as they extend away from the the driver's seat 4, but this inclination angle is not so large as that of the display faces 35*a*, 36*a*. That is, the inclined panel 35 is shaped as a portion bent from the partitioning portion 37 (portion of the base panel 32) and the inclined panel 36 is shaped as a portion bent from the base panel 32.

Namely, the guide slots 33, 34 are formed at positions one-step recessed from the base panel 32. And, of the inclined panel portions connecting the guide slots 33, 34 to the base panel, the panel portions having an upper face oriented toward the driver seated a the drive's seat are referred to herein as the first inclined panel portion 35 and the second inclined panel portion 36.

By operating the plowing depth lever 31 in the fore and aft direction of the vehicle body as being guided along the guide slot 33 of the base panel 32 about a connecting axis connecting the lever 31 to the transmission case 6 and extending in the transverse direction of the vehicle 16 body, the rotary plow 10 is switched over between the lift control engaged condition and the lift control disengaged condition and also the set plowing depth of the lift control is varied. In this, by the display of the display face 35*a* of the inclined panel portion 36, the driver can confirm what operational position the plowing depth lever 31 is set.

By operating the position lever 30 in the fore and aft direction of the vehicle body as being guided along the guide slot 34 of the base panel 32 about a connecting axis connecting the lever 30 to the transmission case 6 and extending in the transverse direction of the vehicle body, the rotary plow 10 is lifted up/down. In this, by the display of the display face 36*a* of the inclined panel portion 36, the driver can confirm what operational position the position lever 30 is set.

The main change speed lever 40 is used for effecting change speed of a gear transmission (not shown) as a traveling main change speed unit for transmitting the driving power of the engine 3 to the front and rear wheels 1, 2. The auxiliary change speed lever 41 is used for effecting 9, change speed of a traveling auxiliary change speed unit (not shown) for transmitting the output of the main change speed unit to the front and rear wheels 1, 2. The PTO lever 42 is used for effecting change speed of an implement change speed unit (not shown) for transmitting the power of the engine 3 to the PTO shaft.

Figure 5:
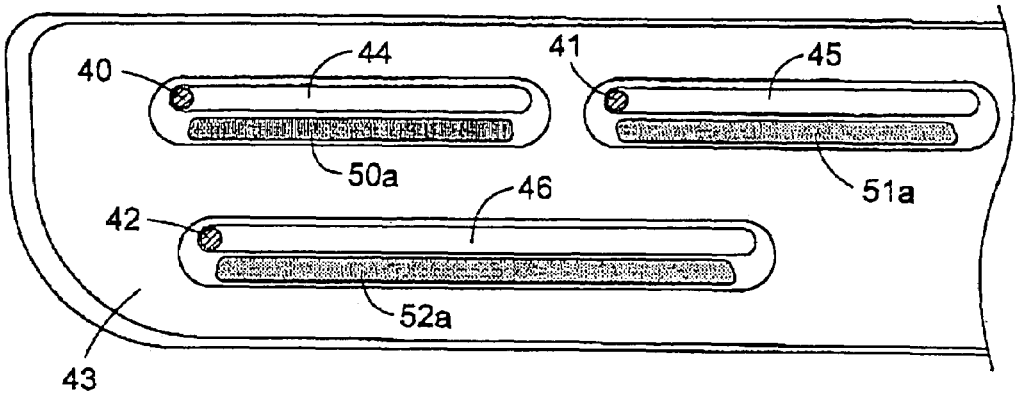
FIG. 5 is a plan view showing mounting portions of a main change speed lever, an auxiliary change speed lever and a PTO lever.
Figure 6:
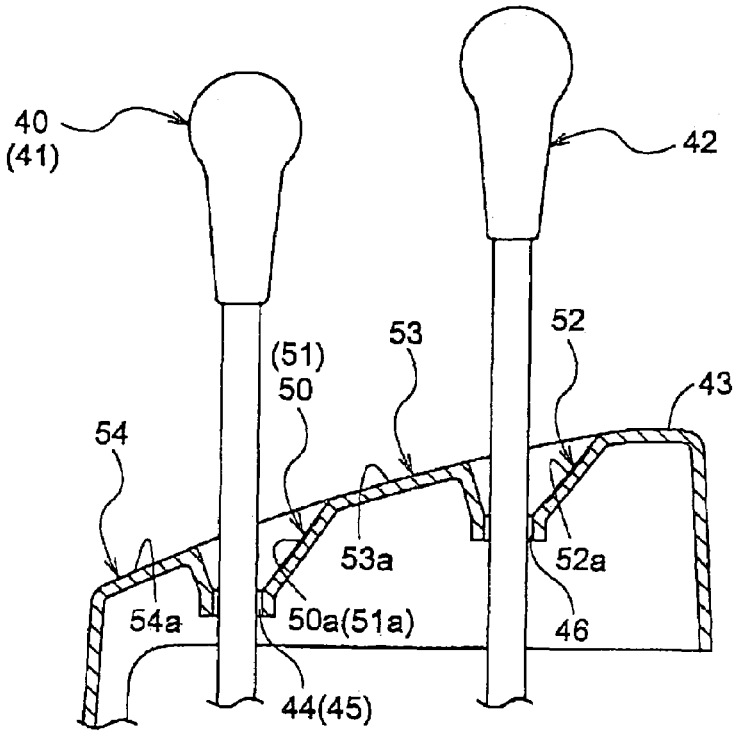
FIG. 6 is a section view showing lever guides for the main change speed lever, the auxiliary change speed lever and the PTO lever.

As shown in FIGS. 5 and 6, the main change speed lever 40 is inserted into one guide slot 44 of a pair of guide slots 44, 45 defined adjacent one transverse (relative to the vehicle body) end of the base panel 43 and juxtaposed in the fore and aft direction of the vehicle body in the base panel 43 secured to the rear wheel fender 56. Whereas, the auxiliary change speed lever 41 is inserted into the other one 45 of the pair of the guide slots 44, 45. The PTO lever 42 is inserted into a guide slot 46 located on the other transverse end of the base panel 43 and extending along the fore and aft direction of the vehicle body. The guide slot 44 forms an operational path of the main change speed lever 40 along the fore and aft direction of the vehicle body. The guide slot 45 forms an operational path for the auxiliary change speed lever 41 along the fore and aft direction of the vehicle body. The guide slot 46 forms an operational path for the PTO lever 42. The main change speed lever 40 and the PTO lever 42 are disposed side by side in the transverse direction of the vehicle body such that front (relative to the vehicle body) portions of the operational path of the main change speed lever 40 and the operational path of the PTO lever 42 are juxtaposed along the transverse direction of the vehicle body. The auxiliary change speed lever 41 and the PTO lever 42 are disposed side by side in the transverse direction of the vehicle body such that rear (relative to the vehicle body) portions of the operational path of the auxiliary change speed lever 41 and the operational path of the PTO lever 42 are juxtaposed along the transverse direction of the vehicle body.

In the base panel 43, of a peripheral edge of the guide slot 44 for the main change speed lever 40, at the edge away from the driver's seat 4, there is formed an inclined panel portion 60 for the main change speed lever 40. Of a peripheral edge of the guide slot 45 for the auxiliary change speed lever 41, at the edge away from the driver's seat 4, there is formed an inclined panel portion 51 for the auxiliary change speed lever 41. Of a peripheral edge of the guide slot 46 for the PTO lever 42, at the edge away from the driver's seat 4, there is formed an inclined panel portion 52 for the PTO lever 42. These three inclined panel portions 50, 51, 52 are also formed as bent pieces of the base panel 43 simultaneously with the formation of the base panel 43.

As shown in FIGS. 5 and 6, the inclined panel portion 60 for the main change speed lever 40 includes a display face 50*a* having characters, marks, etc. for allowing visual confirmation of the operational position of the main change speed lever 40. The inclined panel portion 51 for the auxiliary change speed lever 41 includes a display face 51*a* having characters, marks, etc. for allowing visual confirmation of the operational position of the auxiliary change speed lever 41. The inclined panel portion 52 for the PTO lever 42 includes a display face 52*a* having characters, marks, etc. for allowing visual confirmation of the operational position of the PTO lever 42.

The respective display faces 50*a*, 51*a*, 52*a* of the inclined panel portions 50, 51, 52 have an inclination such that the faces are located higher as extending outwardly away from the guide slots 44, 45, 46. An upper face 54*a* of an upper wall portion 54 disposed on the inner side of the vehicle body than the entire base panel 43, i.e. the guide slots 44, 45 of the base panel 43 and an upper face 53*a* of a partitioning portion 53 partitioning between the two guide slots 45, 46 have a gentle upward inclination so that these upper faces are oriented toward the driver seated at the driver's seat. However, the inclination angles of these respective inclined panel portions 50, 51, 52 are greater than the inclination angle of the base panel 43 so that these portions 50, 51, 62 can be easily seen by the driver. As a result, the level of the display face 52*a* of the inclined panel portion 52 which is one of the inclined panel portions 50, 52 farther from the driver's seat 4 is higher than that of the display face 50*a* of the inclined panel portion 50 closer to the driver's seat 4 so that the display face 52*a* can be easily seen by the driver. The guide slots 44, 45, 46 are all formed at positions one-step recessed from the base panel 43 by bending the base plate 43. As each of the inclined panel portions 50, 51, 52 is provided with an inclination angle toward the driver seated at the driver's seat, the display face thereof can be easily seen by the driver seated at the driver's seat.

By operating the main change speed lever 40 in the fore and aft direction of the vehicle body as being guided along the guide slot 44 of the base panel 43, the traveling main change speed unit is operated for change speed thus effecting a main change speed operation of the traveling speed of the vehicle body. In the course of this, by looking at the display face 50*a* of the inclined panel portion 60, the driver can check which operational position the main change speed lever 40 has been set and can know which speed position among first through fourth speeds the main change speed unit has been set to.

By operating the auxiliary change speed lever 41 in the fore and aft direction of the vehicle body as being guided along the guide slot 45 of the base panel 43, the traveling auxiliary change speed unit is operated for change speed thus effecting an auxiliary change speed operation of the traveling speed of the vehicle body. In the course of this, by looking at the display face 51*a* of the inclined panel portion 51, the driver can check which operational position the auxiliary change speed lever 41 has been set and can know which speed position between the low speed and the high speed the auxiliary change speed unit has been set to.

By operating the PTO lever 42 in the fore and aft direction of the vehicle body as being guided along the guide slot 46 of the base panel 43, the implement change speed unit is operated for change speed, thus varying the driving speed of the rotary plow 10 or stopping the rotary plow 10. In the course of this, by looking at the display face 52*a* of the inclined panel portion 52, the driver can check which operational position the PTO lever 42 has been set and can know which of the high, low and super-low condition the implement change speed unit has been set to.

Figure 8:
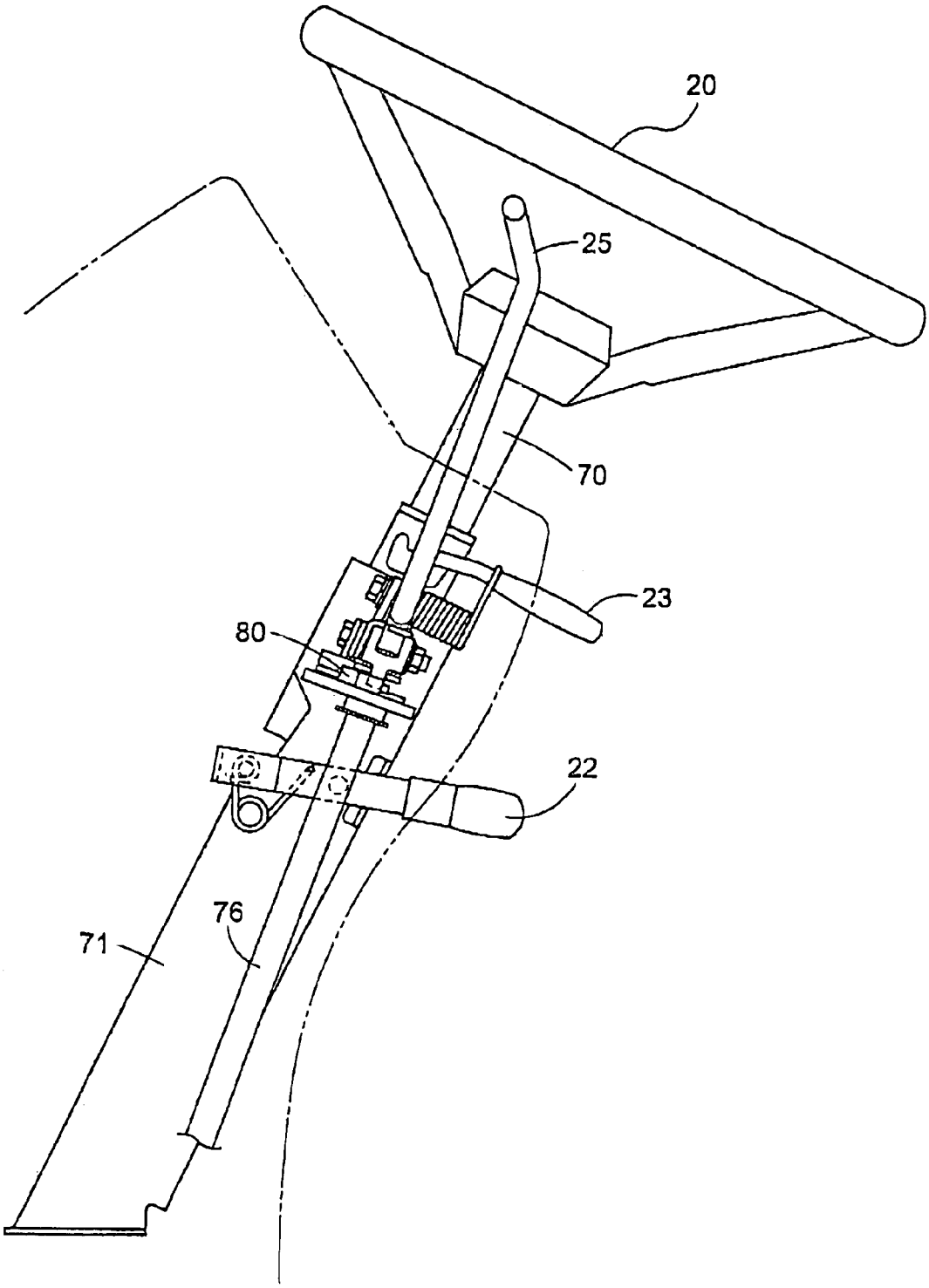
FIG. 8 is a side view showing the mounting portion of the steering wheel.

As shown in FIG. 8, the tilt lever 23 is used for allowing attaching angle adjustment of the steering wheel 20 by switching over a tilt lock mechanism (not shown) between a locked condition and a lock-released condition. The tilt lock mechanism is disposed between a handle stay 70 and a handle post 71 for locking pivotal fore-and-aft displacement of the handle stay 70 to which the steering wheel 20 is rotatably attached, relative to the handle post 71.

The hand accelerator lever 21 is used for manually operating an accelerator (not shown) of the engine 3 and also setting the accelerator. The double speed lever 22 is used for operating a front wheel accelerator (not shown), thus selecting between a four wheel drive mode wherein an average peripheral speed of the right and left front wheels 1 is set higher than an average peripheral speed of the right and left rear wheels 2 and a further four wheel drive mode wherein the average peripheral speed of the right and left front wheels 1 is set equal or substantially equal to the average peripheral speed of the right and left rear wheels 2. The parking brake lever 24 is used for engaging a parking brake with maintaining a traveling brake (not shown) engaged. The lift lever 26 is used for operating a control switch 72 (see FIG. 7) of a lift electric motor (not shown), thereby to operate the hydraulic control valve of the lift arms 7 by the lift electric motor, so that the rotary plow 10 is manually lifted up/down by overriding the position lever 30 and the lift control. The forward/reverse lever 25 is used for switching a forward/reverse switching unit (not shown) mounted in the traveling main change speed unit, thereby to switch over the vehicle body between a forward traveling condition and a reverse traveling condition.

The handle accelerator lever 21, the double speed lever 22, the parking brake lever 24, the lift lever 26, and the forward/reverse lever 26 are mounted by a mounting construction shown in FIGS. 7 and 8.

More particularly, the handle accelerator lever 21 is mounted to a support member 73 disposed on the right side of the handle post 71 secured to the vehicle frame to be pivotable along the fore and aft direction of the vehicle body.

The double speed lever 22 is attached to an end portion of a lever support shaft 74 extending through the handle post 71 in the transverse direction of the vehicle body and projecting to the left side from the handle post 71 to be pivotable about an axis of the lever support shaft 74.

The parking brake lever 24 is attached to an end of the lever support shaft 74 projecting to the right side from the handle post 71 so that the lever 24 can be pivotally operated about the axis of the lever support shaft 74.

The forward/reverse lever 25 is attached to a support member 75 provided on the left outer side of the handle post 71 to be pivotable along the fore and aft direction of the vehicle body.

The lift lever 26 is attached to the handle stay 70 via a case of the control switch 72 to be pivotable along the vertical direction of the vehicle body across a neutral position.

Figure 9:
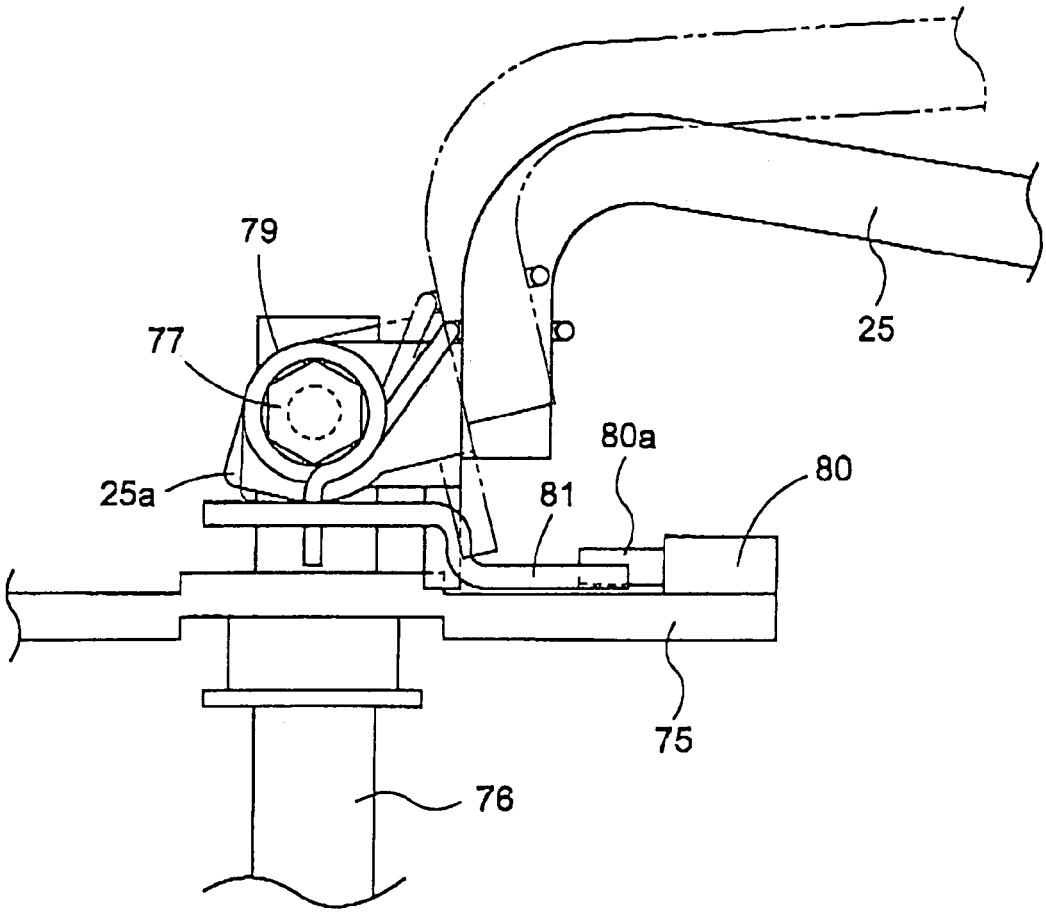
FIG. 9 is a side view of a mounting portion of an implement lift switch.
Figure 10:
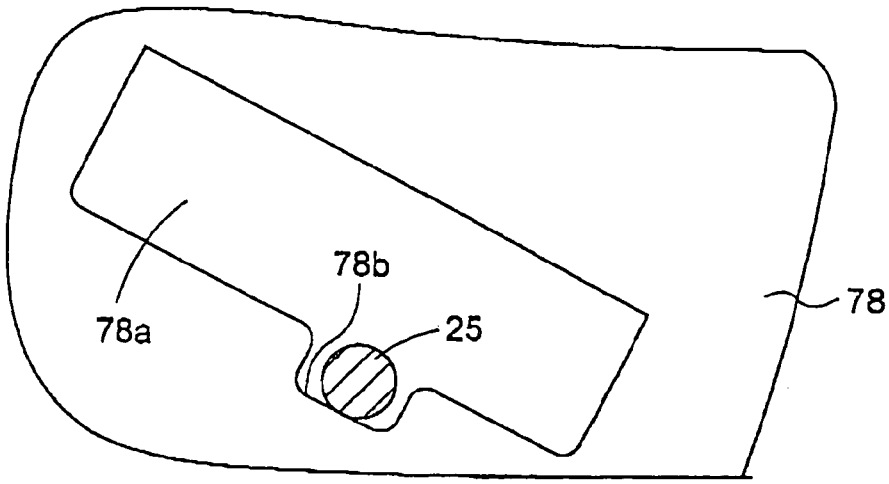
FIG. 10 is a front view showing a lever guide for a forward/reverse lever.
Figure 11:
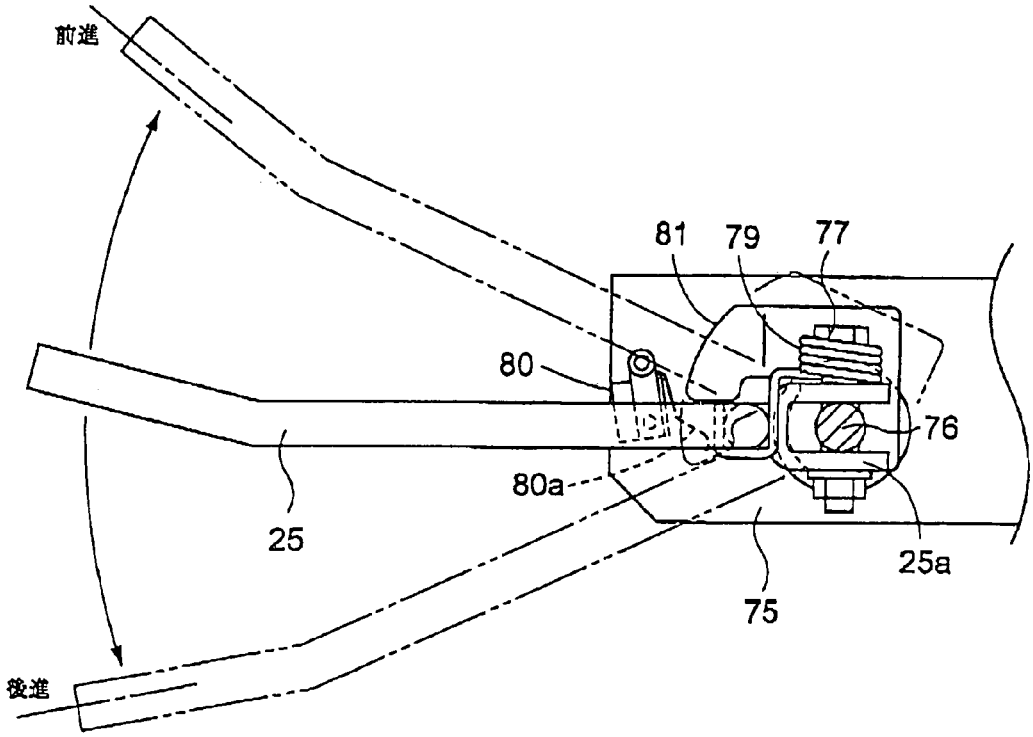
FIG. 11 is a plan view showing the mounting portion of the implement lift switch.

As shown in FIGS. 9, 11, etc., a forked connecting portion 25*a* of the forward/reverse lever 26 is pivotally connected, via a connecting bolt 77, to an upper end of a rotary coupling shaft 76 oriented vertical relative to the vehicle body. So that, the forward/reverse lever 25 is pivoted to the front or rear side of the vehicle body about the axis of the rotary coupling shaft 76 and pivoted also in the vertical direction of the vehicle body about the axis of the connecting bolt 77. A base end rod portion of the forward/reverse lever 25 is inserted through a base panel 78 shown in FIG. 10. So that, when the forward/reverse lever 26 is pivotally operated about the axis of the rotary coupling shaft 76 in the fore and aft direction of the vehicle body along a guide slot 78*a* defined in the base panel 78, the rotary coupling shaft 76 is rotated and this operational force is transmitted to a control portion of the forward/reverse switching unit, so that this mechanism is switched over. On the other hand, when the forward/reverse lever 25 is operated to the neutral position, because of a downward pivotal urging force applied to the forward/reverse lever 26 from a lock spring 79 which acts on the connecting portion 25*a*, the base end rod portion of the forward/reverse lever 25 enters a locking recess 78*b* formed in the base panel 78, whereby the forward/reverse lever 25 is located at the neutral position and the forward/reverse switching unit can be locked at the neutral condition.

As shown in FIGS. 9 and 11, at the end of the support member 75, there is attached an implement lift switch 80. When the forward/reverse lever 25 is operated to the reverse traveling position, a control element 81 connected to the rotary coupling shaft 76 to be rotatable therewith presses a control portion 80*a* of the implement lift switch 80, whereby the implement lift switch 80 is turned ON to output an instruction for elevating the lift arms 7. That is to say, when the forward/reverse switching unit is switched to the reverse traveling condition, by the above-described function of the implement lift switch 80, the rotary plow 10 is automatically elevated to the elevated inoperative condition. The control piece 81 acts as a spring receiver for retaining one end of the lock spring 79.

Figure 12:
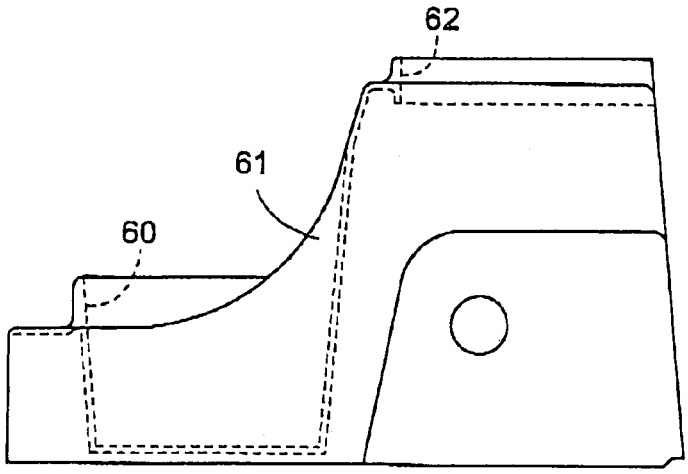
FIG. 12 is a side view showing a cover including a cup holder.

As shown in FIGS. 2 and 12, the cup holder 60 is used for holding a cup, a bottle or the like. This cup holder 60 is formed simultaneously with formation of a resin cover 61 secured to the vehicle body in such a way as to cover a connecting portion where the protection frame 6 is connected to the support frame of the vehicle body to be pivotable up and down. The holder 60 is formed at a portion of the cover 61 located on the forward side of the vehicle body relative to a protection frame inserting hole 62 of the cover 61.

Second Embodiment

Figure 13:
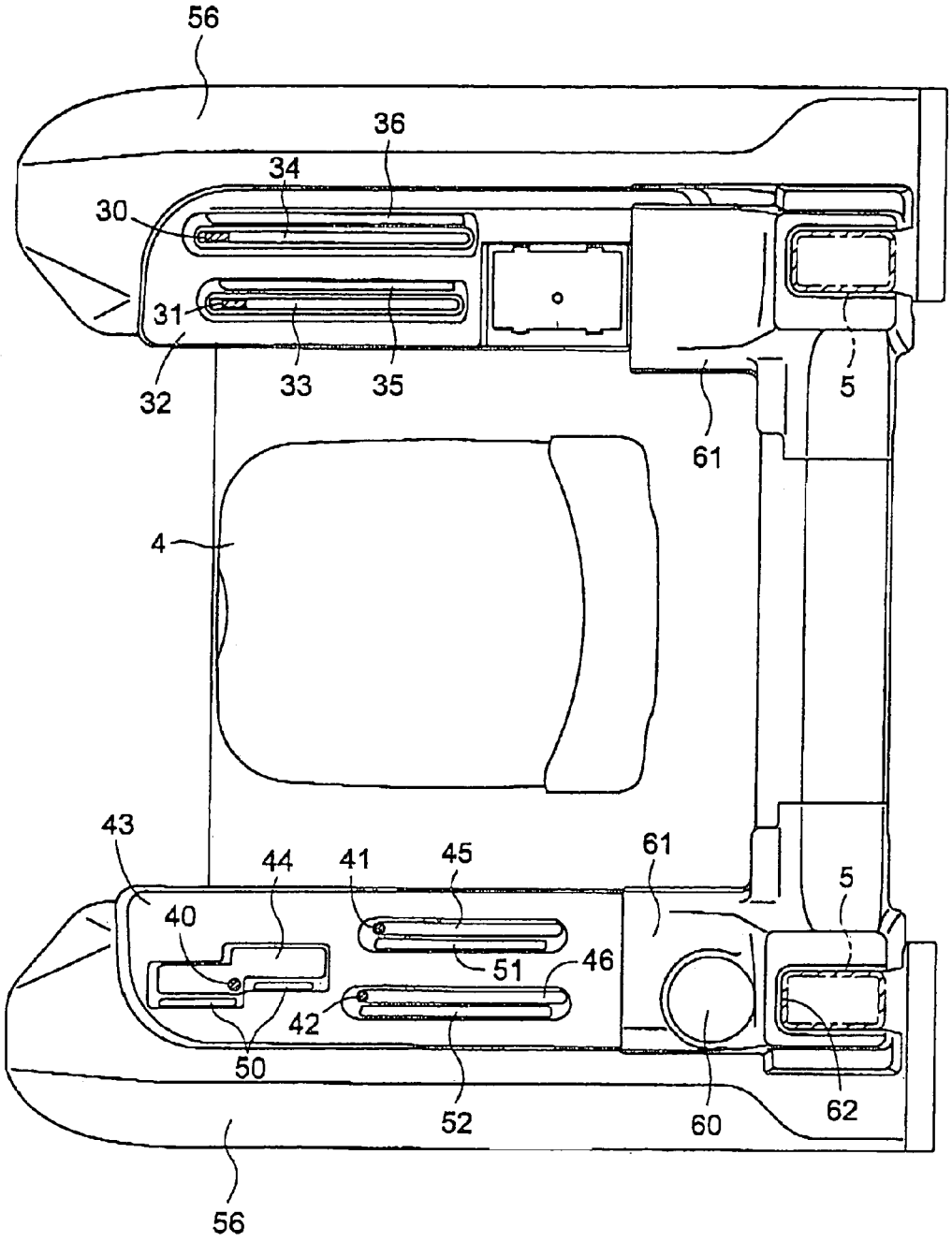
FIG. 13 is a plan view showing a driver's section including a control panel unit relating to a second embodiment.
Figure 14:
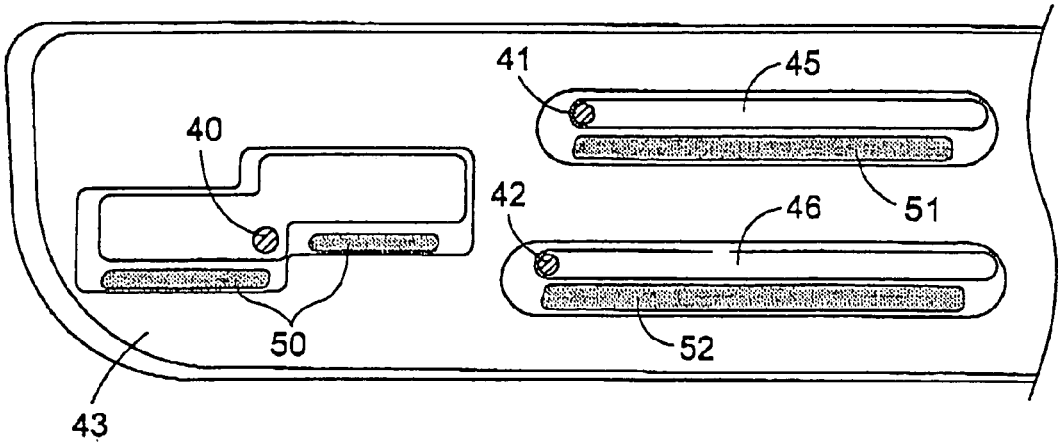
FIG. 14 is a plan view of a control panel unit including a main change speed lever, an auxiliary change speed lever and a PTO lever.
Figure 15:
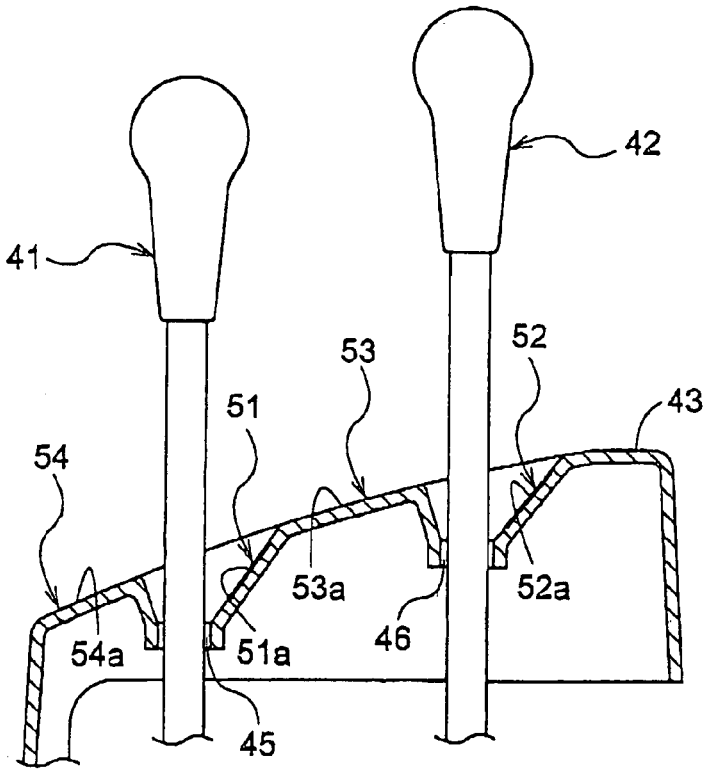
FIG. 15 is a section view showing a control panel unit relating to the second embodiment.
Figure 16:
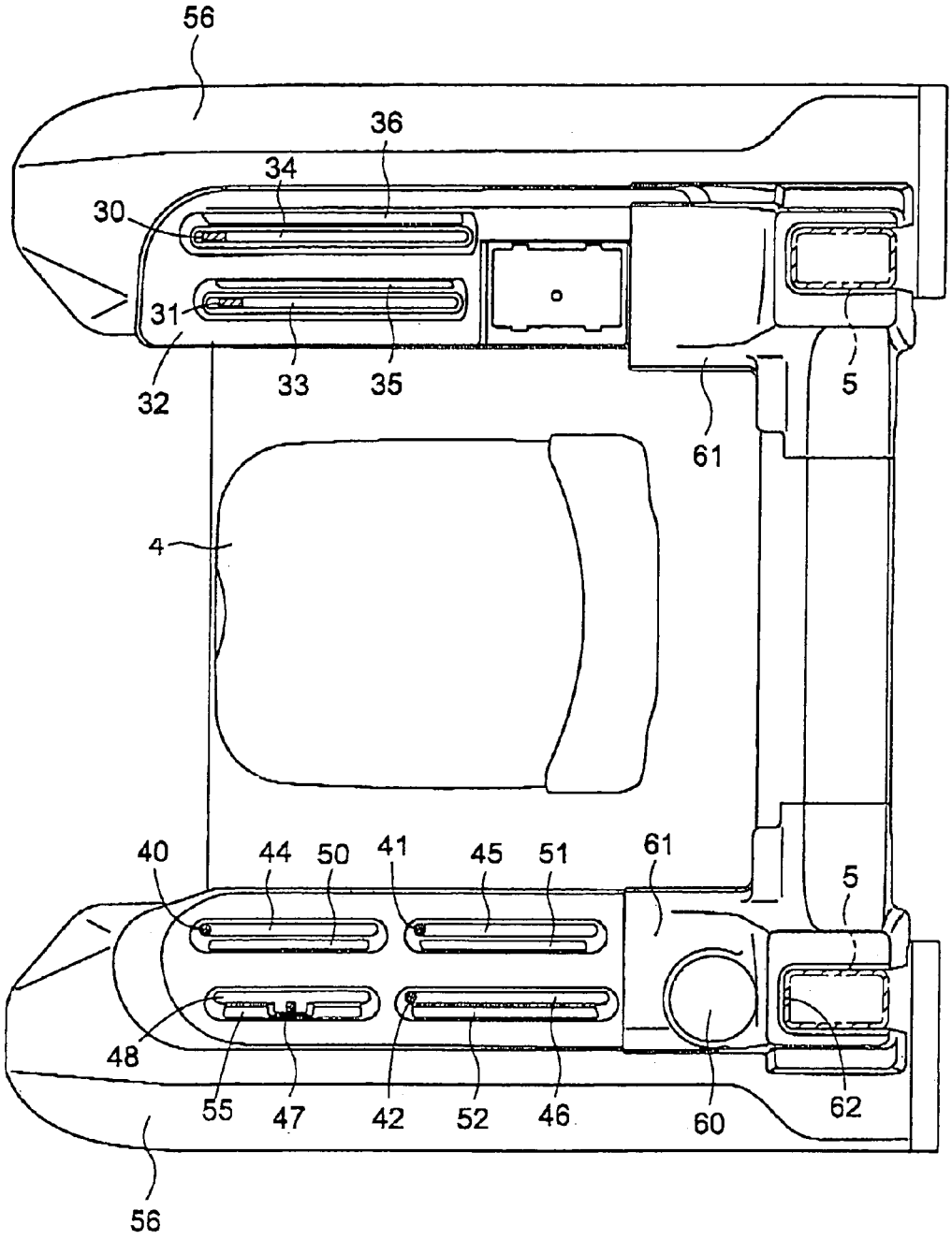
FIG. 16 is a plan view showing a driver's section including a control panel unit relating to a third embodiment.
Figure 17:
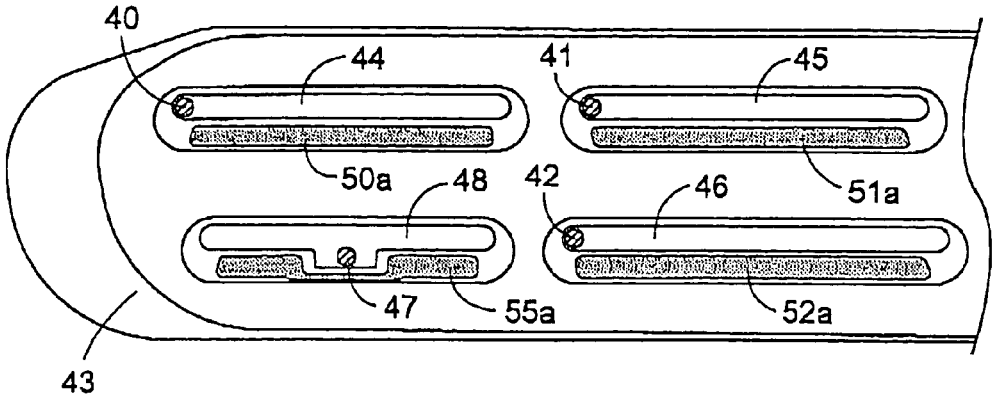
FIG. 17 is a plan view showing a control panel unit including a main change speed lever, an auxiliary change speed lever, a PTO lever and a forward/reverse lever.
Figure 18:
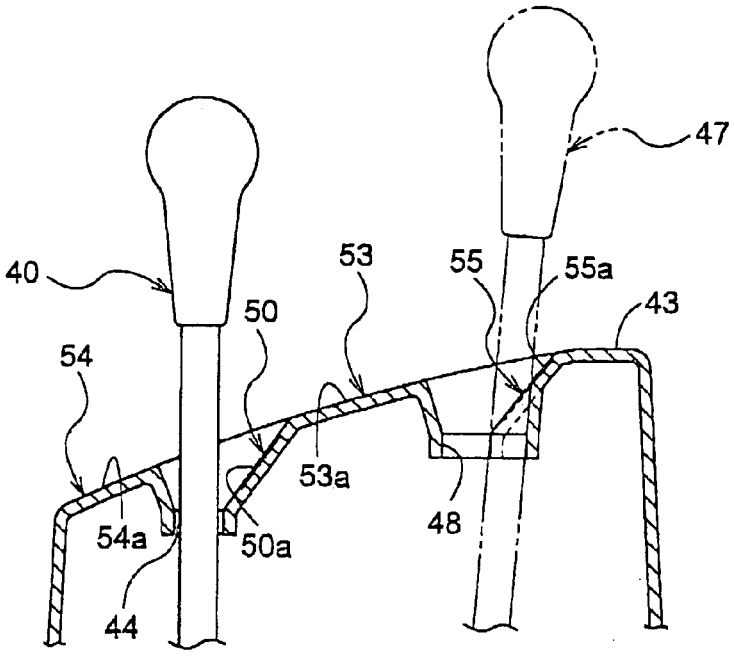
FIG. 18 is a section view showing a control panel unit relating to the third embodiment.
Figure 19:
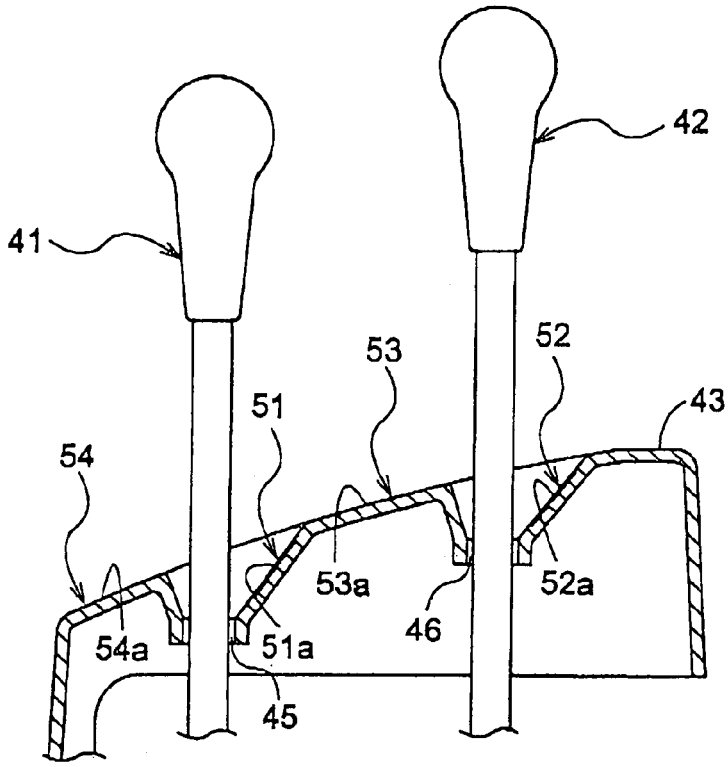
FIG. 19 is a further section view showing a control panel unit relating to the third embodiment.

FIGS. 13-15 show a construction of a driver's section relating to a second embodiment. In the case of this driver's section construction, on the right lateral side of the driver's seat 4, the position lever 30, the plowing depth lever 31, as the control levers, and the base panel 32 providing guiding of these two levers 20, 21 are provided. On the left lateral side of the driver's seat 4, the main change speed lever 40, the auxiliary change speed lever 41 and the PTO lever 42, as the control levers, and the base panel 43 providing guiding of these levers 40, 41, 42 are provided.

In the driver's section construction, the position lever 30, the plowing depth lever 31, the inclined panel portion 36 for the position lever 30, and the inclined panel portion 35 for the plowing depth lever 31 are same as those of the first embodiment described above.

The main change speed lever 40 is used for change speed operation of a hydraulic stepless change speed unit (HST) (not shown) as the traveling main change speed unit. The auxiliary change speed lever 41 is used for change speed operation of a traveling auxiliary change speed unit which transmits an output from the HST to the front and rear wheels 1, 2. The PTO lever 42, like the one in the first embodiment, is used for operating the implement change speed unit.

In the case of the driver's section of this embodiment, the PTO lever 42 and the auxiliary change speed lever 41 are juxtaposed in the transverse direction of the vehicle body so that the operational path of the PTO lever 42 formed by the guide slot 46 of the base panel 43 and the operational path of the auxiliary change speed lever 41 formed by the guide slot 45 of the base panel 43 may be juxtaposed in the transverse direction of the vehicle body. The base panel 43, and the inclined panel portions 51, 52 for displaying the operational positions of the PTO lever 42 and the auxiliary lever 41 are the same as the base panel 43, and the inclined panel portions for the PTO lever 42 and the auxiliary change speed lever 41 of the first embodiment.

Third Embodiment

FIGS. 16-19 show a driver's section construction relating to a third embodiment. In the case of this driver's section construction, on the right lateral side of the driver's seat 4, there are provided the position lever 30 and the plowing depth lever 31 as the control levers and the base panel 32 for providing guiding of these lever 30, 31. On the left lateral side of the driver's seat 4, there are provided the main change speed lever 40, the auxiliary change speed lever 41, the forward/reverse lever 47, the PTO lever 42, as the control levers and the base panel 43 for providing guiding of these respective levers 40, 41, 42, 47.

In this driver's section construction, the position lever 30, the plowing depth lever 31, the inclined panel portion 36 for the position lever 30 and the inclined panel portion 35 for the plowing depth lever 31 are same as those of the first embodiment.

The main change speed lever 40, like the one in the foregoing embodiment, is used for change speed operation of the gear transmission as the traveling main change speed unit. The auxiliary change speed lever 41, like the one in the first embodiment, is used for change speed operation of the traveling auxiliary change speed unit. The forward/reverse lever 47 is used for operating the forward/reverse switching unit mounted in the gear transmission. The PTO lever 42, like the one in the first embodiment, is used for operating the implement change speed unit.

In the case of this driver's section construction, at the front portion of the base panel 43 relative to the vehicle body, the main change speed lever 40 and the forward/reverse lever 47 are juxtaposed in the transverse direction of the vehicle body so that the operational path of the main change speed unit 40 formed by the slot 44 of the base panel 43 and the operational path of the forward/reverse lever 47 formed by the guide slot 48 of the base panel 43 may be juxtaposed in the transverse direction of the vehicle body. At the rear portion of the base panel 43, the PTO lever 42 and the auxiliary change speed lever 41 are juxtaposed in the transverse direction of the vehicle body so that the operational path of the PTO lever 42 formed by the slot 46 of the base panel 43 and the operational path of the auxiliary change speed lever 41 formed by the slot 45 of the base panel 43 may be juxtaposed in the transverse direction of the vehicle body. And, for displaying the operational positions of the respective levers 40, 41, 42, 47, the inclined panel portions 50, 51, 52, 55 are constructed as follows.

Namely, the display faces 50*a*, 51*a*, 52*a*, 65*a* of the inclined panel portions 50 51, 52, 55 for the respective levers 40, 41, 42, 47 are inclined so that these faces are formed higher as extending outwardly away from the guide slots 44, 45, 46, 47, i.e. toward the driver seated at the driver's seat. More particularly, the display faces 60*a*, 61*a*, 52*a*, 55*a* are bent from the base panel to have a predetermined inclination angle relative to an upper face 53*a* of a partitioning portion 53 partitioning between the main change speed lever guide slot 44 and the forward/reverse lever guide slot 48 and also between the auxiliary change speed lever guide slot 45 and the PTO lever guide slot 46 of the base panel 43.

The top surface of the base panel 43 including the upper face 53*a* of the partitioning portion 53 and the upper face 54*a* of the upper wall portion 54 located closer to the driver's seat 4 than the guide slots 44, 45 are also inclined as being formed higher as extending away from the driver's seat 4.

With these arrangements, the level of the display face 55*a* of the inclined panel portion 55 for the forward/reverse lever 47 is higher than that of the display face 60*a* of the inclined panel portion 50 for the main change speed lever 40 closer to the driver's seat 4. Similarly, the level of the display face 52*a* of the inclined panel portion 52 for the PTO lever 42 is higher than that of the display face 51*a* of the inclined panel portion 61 for the auxiliary change speed lever 41 closer to the driver's seat 4 than the PTO lever 42.

Fourth Embodiment

Figure 20:
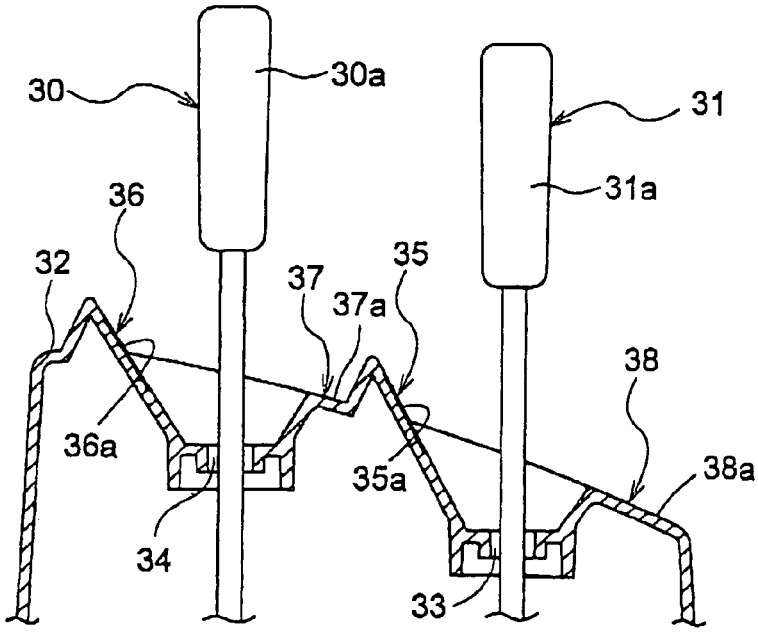
FIG. 20 is a section view showing a control panel unit relating to a fourth embodiment.

FIG. 20 shows a fourth embodiment including further base panels, including the base panel 32 on the right lateral side of the driver's seat and the base panel 43 on the left lateral side of the driver's seat. Of these, the base panel 32 for the position lever 30 and the plowing depth lever 31 on the right side will be explained for example. In this base panel 32, the inclined panel portions 35, 36 are configured such that portions of the display faces 35*a*, 36*a* thereof project higher than the upper faces 37*a*, 38*a* of the partitioning portion 37 and the upper wall portion 38 of the base panel 32.

Fifth Embodiment

Figure 21:
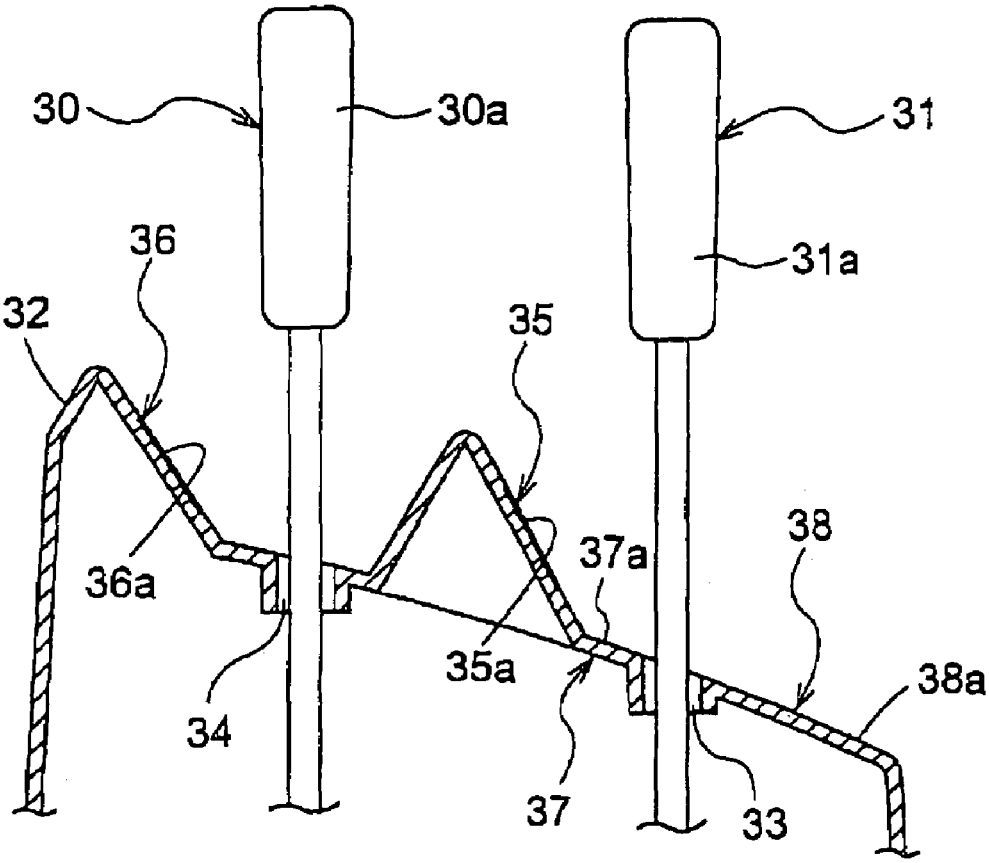
FIG. 21 is a section view showing a control panel unit relating to a fifth embodiment.
Figure 22:
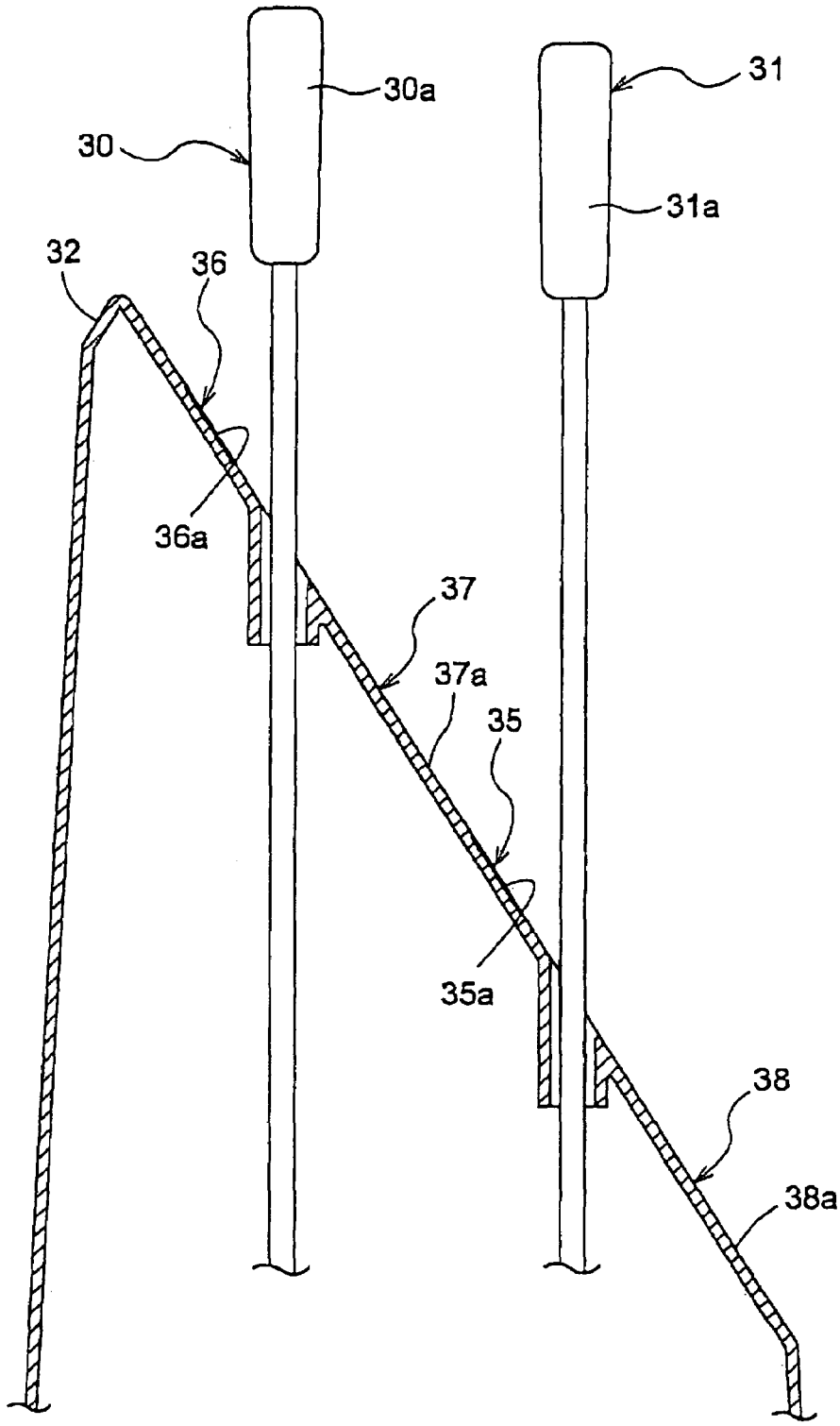
FIG. 22 is a section view showing a control panel unit relating to a known base panel configuration.

FIG. 21 shows a fifth embodiment including further base panels, including the base panel 32 on the right lateral side of the driver's seat and the base panel 43 on the left lateral side of the driver's seat. Of these, the base panel 32 for the position lever 30 and the plowing depth lever 31 on the right side will be explained for example. In this base panel 32, the inclined panel portions 35, 36 are configured such that the entire display faces 35*a*, 36*a* thereof project higher than the upper faces 37*a*, 38*a* of the partitioning portion 37 and the upper wall portion 38 of the base panel 32.

The present invention may be used not only in a tractor equipped with a plow implement described in the foregoing embodiment, but in various other types of agricultural machines or vehicles such as a combined harvester, a rice planting machine, etc. or in various types or utility machines or vehicles such as a lawn mower, a construction work vehicle, etc.

The invention claimed is:

1. A control panel having a first control lever and a second control lever, operable by a driver seated at a driver's seat of a utility vehicle, the panel unit comprising:

a base panel which covers the first control lever except for a first control grip area and second control lever except for a second control grip area, the base panel being located on an upper surface of a rear wheel fender located laterally of the driver's seat and the base panel inclined downward toward the driver's seat;

a first guide slot defined in the base panel along an operational displacement of the first control lever;

a second guide slot defined in the base panel along an operational displacement of the second control lever, the second guide slot located to a lateral side of the first guide slot;

a first inclined panel portion inclined by a predetermined angle relative to the base panel so as to orient a surface thereof toward the driver and extending adjacent and along a length of the first guide slot, wherein said first inclined panel portion is a bent piece formed by bending said base panel and the surface of the first inclined panel portion is flat;

a second inclined panel portion inclined by a predetermined angle relative to the base panel so as to orient a surface thereof toward the driver and extending adjacent and along a length of the second guide slot, wherein said second inclined panel portion is a bent piece formed by bending said base panel and the surface of the second inclined panel portion is flat;

a first display face formed in the surface of the first inclined panel portion and configured for displaying operational positions of the first control lever; and a second display face formed in the surface of the second inclined panel portion and configured for displaying operational positions of the second control lever.

2. The control panel unit according to claim 1, wherein said first inclined panel portion forms substantially a half of a peripheral edge of said first guide slot and said second inclined panel portion forms substantially a half of a peripheral edge of said second guide slot.

3. The control panel unit according to claim 1, wherein said second display face is disposed farther from the driver's seat than said first display face, and said second display face is located at a higher level than said first display face.

4. The control panel unit according to claim 1, wherein a portion of said base panel is laid between said first guide slot and said second guide slot.

* * * * *